United States Patent [19]

Rosswurm et al.

[11] Patent Number: 4,996,967

[45] Date of Patent: Mar. 5, 1991

[54] APPARATUS AND METHOD FOR GENERATING A HIGHLY CONDUCTIVE CHANNEL FOR THE FLOW OF PLASMA CURRENT

[75] Inventors: Mark A. Rosswurm; Luigi Tozzi, both of Columbus, Ind.

[73] Assignee: Cummins Engine Company, Inc., Columbus, Ind.

[21] Appl. No.: 440,027

[22] Filed: Nov. 21, 1989

[51] Int. Cl.[5] ..... F02P 3/06; F02P 3/02

[52] U.S. Cl. ..... 123/598; 123/620; 123/627; 123/654; 123/656

[58] Field of Search ..... 123/143 B, 620, 627, 123/654, 598, 656

[56] References Cited

U.S. PATENT DOCUMENTS

| | | | |
|---|---|---|---|
| 3,842,818 | 10/1974 | Cowell et al. | 123/143 A |
| 3,842,819 | 10/1974 | Atkins et al. | 123/143 A |
| 4,029,072 | 6/1977 | Goto et al. | 123/143 B |
| 4,083,347 | 4/1978 | Gräther et al. | 123/656 |
| 4,122,816 | 10/1978 | Fitzgerald et al. | 123/143 B |
| 4,317,068 | 2/1982 | Ward et al. | 123/654 |
| 4,345,575 | 8/1982 | Jorgensen | 123/620 |
| 4,366,801 | 1/1983 | Endo et al. | 123/620 |
| 4,369,756 | 1/1983 | Ezoe | 123/620 |
| 4,369,758 | 1/1983 | Endo | 123/620 |
| 4,398,526 | 8/1983 | Hamai et al. | 123/143 B |
| 4,407,259 | 10/1983 | Abo | 123/620 |
| 4,418,660 | 12/1983 | Endo et al. | 123/143 B |
| 4,433,669 | 2/1984 | Ishikawa et al. | 123/620 |
| 4,445,491 | 5/1984 | Ishikawa et al. | 123/143 B |
| 4,448,181 | 5/1984 | Ishikawa et al. | 123/620 |
| 4,455,989 | 6/1984 | Endo et al. | 123/620 |
| 4,471,732 | 9/1984 | Tozzi | 123/143 B |
| 4,487,177 | 12/1984 | Ishikawa | 123/654 |
| 4,510,915 | 4/1985 | Ishikawa et al. | 123/620 |
| 4,558,685 | 12/1985 | Ishikawa et al. | 123/620 |
| 4,562,823 | 1/1986 | Moritugu et al. | 123/620 |
| 4,619,241 | 10/1986 | Yoshinari | 123/620 |
| 4,672,928 | 6/1987 | Hartig | 123/143 B |
| 4,739,185 | 4/1988 | Lee et al. | 123/620 |
| 4,774,914 | 10/1988 | Ward | 123/598 |

OTHER PUBLICATIONS

"Pulsed Plasma Ignitor for Internal Combustion Engines", Fitzgerald, *Society of Automotive Engineers,* No. 760764.

"An Investigation of a Coaxial Spark Igniter with Emphasis on its Practical Use", Clements et al., *Combustion and Flame,* vol. 25, p. 189.

"Design of a Plasma Jet Ignition System for Automotive Application", Asik et al., *Society of Automotive Engineers,* No. 770355.

*Primary Examiner*—Tony M. Argenbright
*Assistant Examiner*—Robert E. Mates
*Attorney, Agent, or Firm*—Woodard, Emhardt, Naughton, Moriarty & McNett

[57] ABSTRACT

An apparatus and method for generating a highly conductive channel for the flow of plasma current between the electrodes of an ignitor gap device are disclosed. A high voltage transformer having a high turns ratio is used to produce a high voltage spark across an ignitor gap. Subsequently, a high voltage low turns ratio transformer is used to supply a pre-plasma current signal to the ignitor gap at a predetermined time following the high voltage spark thereby ensuring that the ionized channel is developed to a more conductive state prior to introduction of the pre-plasma signal into the ignitor gap. Once the sustaining voltage for sustaining plasma flow through the channel has stabilized to a sufficiently low voltage, a high current main plasma signal is supplied to the ignitor gap thereby expanding plasma flow in the area surrounding the ignitor gap and providing a high quality ignition source for use in internal combustion engines.

24 Claims, 14 Drawing Sheets

APPARATUS AND METHOD FOR GENERATING A HIGHLY CONDUCTIVE CHANNEL FOR THE FLOW OF PLASMA CURRENT

BACKGROUND OF THE INVENTION

This invention relates to internal combustion ignition systems and more particularly to plasma ignition devices.

As is well known in the art, the plasma ignition concept improves the ability of an internal combustion engine to operate on lean fuel-air mixture with ensuing gains in fuel economy and reduced vehicle cost by way of emission equipment reductions. A low energy plasma igniter for internal combustion engines as disclosed in U.S. Pat. No. 4,471,732 to Tozzi, uses an electrical pulse forming network to generate a low energy plasma useful in igniting a lean fuel air mixture.

As is shown in U.S. Pat. No. 4,398,526 to Hamai et al., a prior art plasma ignition system may require an additional voltage applied to an ignition plug to facilitate the flow of plasma energy. In Hamai, a high frequency oscillating voltage is supplied to the spark plug prior to the plasma current flow thereby inducing multiple sparks at the ignition electrodes of Hamai et al. Other patents and publications disclosing plasma ignition systems include U.S. Pat. No. 4,739,185 to Lee et al., U.S. Pat. No. 4,672,928 to Hartig, U.S. Pat. No. 4,448,181 to Ishikawa et al., and U.S. Pat. No. 4,336,801 to Endo et al., U.S. Pat. No. 4,317,068 to Ward et al., U.S. Pat. No. 3,842,818 to Cowell et al., U.S. Pat. No. 3,842,819 to Waterson et al., "Pulsed Plasma Ignitor for Internal Combustion Engines", Fitzgerald, *Society of Automotive Engineers*, No. 760764, "An Investigation of a Coaxial Spark Igniter with Emphasis on its Practical Use", Clements et al, *Combustion and Flame*, Vol. 25, p. 189, "Design of a Plasma Jet Ignition System for Automotive Application", Asik et al., *Society of Automotive Engineers*, No. 770355. None of the systems disclosed in the above references includes any means to decouple the spark event from the plasma flow event.

Conceptually, in order for plasma flow to take place, a high voltage arc is supplied to the ignition electrodes. Once the voltage across the electrodes exceeds the breakdown voltage, the actual voltage across the electrodes will drop from approximately 20,000 volts to 500 to 3,000 volts when the arc is established across the electrode gap. To generate the plasma flow, the ionized molecules in the immediate vicinity of the arc are stimulated to an excited state or ionized state, thereby providing charge carriers and thus a lower resistance path for the flow of current. After creation of the ionized path between the spark plug electrodes, a current pulse is supplied to the electrodes and plasma flow will occur across the gap.

One of the difficulties experienced with plasma flow driver electronics is the requirement that most of the electronic circuit components must be capable of withstanding fairly high voltages on the order of 1000 to 3000 volts. Additionally, transformer windings and capacitor sizes are directly impacted by the voltage and current requirements of such a system, commonly referred to as transformer volt-seconds capability. A device which reduces the sustaining voltage necessary for plasma current to flow between electrodes of an ignitor gap would result in lower cost with regard to the voltage tolerances of circuit components, higher efficiency in regard to power requirements for inducing plasma flow, and reduced radiated electromagnetic interference. Reductions in maximum voltages requisite to induce plasma flow will also directly affect the volume or size of transformers required in the driver circuitry. The volume of components necessary to deliver the voltage and current to the electrodes or ignitor gap is directly related to transformer volt-seconds capability.

SUMMARY OF THE INVENTION

A method for creating a highly conductive ionized channel for the flow of plasma current according to the present invention includes the steps of supplying a high voltage spark to one of two electrodes separated by an air gap, delaying a predetermined time period, and supplying a short duration high voltage-high current pre-plasma pulse to expand the conductive ionized channel and lower the resistance of the channel and supplying a low voltage-high current main plasma signal to the first electrode to induce a main plasma flow between the electrodes.

According to another embodiment of the present invention, a device for creating a highly conductive ionized channel for the flow of plasma current according to the present invention includes an ignitor having a first and a second electrode, a first circuit means for supplying a high voltage signal to the first electrode and inducing a high voltage spark from the first to the second electrode, a second circuit means for supplying a pre-plasma current pulse to the first electrode after the high voltage spark has formed across the ignitor device electrodes, timing control means connected to the first and the second circuit means for delaying the pre-plasma current pulse a predetermined time period after the occurrence of said high voltage spark, and power supply means for supplying power to the first and second circuit means.

One objective of the invention is to control signal timing in creating a conductive ionized channel across an electrode gap.

Another object of the invention is to reduce the voltage required to initiate and sustain plasma flow.

A further object of the invention is to reduce component cost and size by way of reducing the voltage and the volt-seconds requirements for producing plasma flow.

Related objects and advantages of the present invention will be apparent from the following description.

DESCRIPTION OF THE PREFERRED EMBODIMENT

Figure 1:
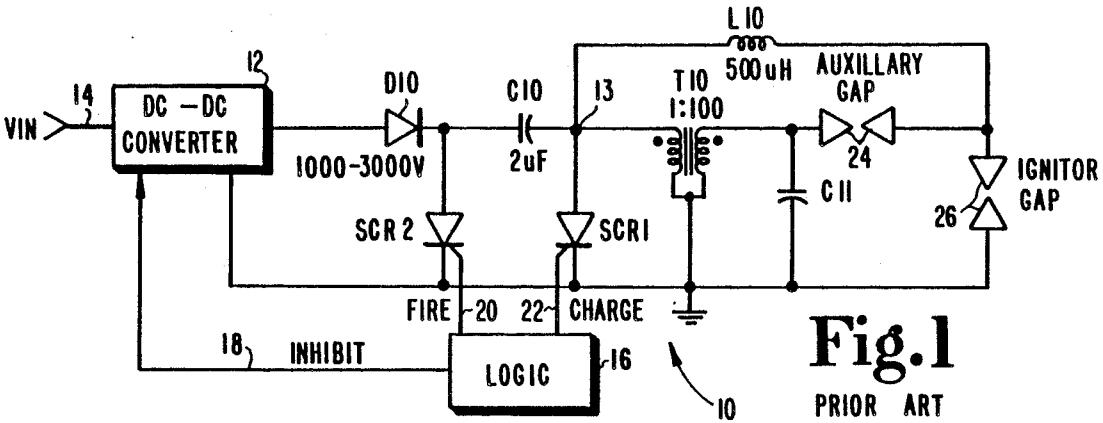
Fig.1 PRIOR ART
FIG. 1 is an electrical schematic of a pulse forming network of the prior art.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an electrical schematic of a plasma ignition system 10 according to the prior art is shown in FIG. 1. The circuit of FIG. 1 uses a DC-DC converter 12 to convert a low voltage from signal path 14, typically 12 to 16 volts DC, into a high DC voltage required to supply current into a plasma channel. Typically the DC-DC converter voltage requirement is in the 1,000 to 3,000 volt range. Initially in the plasma ignition process SCR1 is turned on by the logic control circuit 16 to enable capacitor C10 to charge to the final DC-DC converter voltage output set point. When ignition and plasma flow is desired, switch SCR2 is turned on to apply the voltage potential of capacitor C10 to the primary of transformer T10. The voltage across the secondary of transformer T10 builds up in a sinusoidal wave form due to the internal capacitance of transformer T10 and the capacitance of capacitor C11. When the voltage across the auxiliary gap is sufficient to break down the air insulation, the auxiliary gap 24 conducts and a high potential is thereafter applied to the ignitor gap 26 of the plasma ignition system 10. When the plasma igniter gap 26 air insulation breaks down, an electrical conducting path to ground exists through the pulse shaping inductor L10, and C10 discharges the remainder of the stored charge or energy into the igniter gap as current to stimulate plasma flow. C10 and L10 resonate to form a damped-sine current pulse, as desired, in the plasma igniter gap.

One disadvantage with the ignition system 10 of the prior art circuit shown in FIG. 1 is the use of costly high voltage switches to charge and discharge the energy storage capacitor C10. A second disadvantage is the power dissipation which occurs across the auxiliary gap 24 and in pulse transformer T10. In order to generate a 0.150 joule pulse in the ignitor, capacitor C10 must store approximately 0.5 joules, resulting in an effective energy efficiency of 30%. The lack of efficiency is explained by the dissipation of power in the secondary of the transformer T10. The high turns ratio required in order to create the 1 to 100 primary to secondary ratio of transformer T10 results in a fairly high resistance in the secondary winding of transformer T10.

In order to maintain the desired plasma channel conductivity, capacitor C10 must be charged to 1,000 to 3,000 volts by the DC-DC converter 12. Therefore, the charge/fire switches, SCR1 and SCR2, must be rated to at least 3,000 volts. The capacitor C10 must also be rated to withstand at least 3,000 volts, with a 3,500 volt or more reliability rating desired. Capacitor C11, which stores energy to ensure the plasma igniter gap has sufficiently low impedance after the auxiliary gap conducts, must have a voltage rating larger than the voltage generated in the secondary of the high voltage transformer, i.e., in the range of 30 kilovolts to 40 kilovolts. A further shortcoming of the circuit of FIG. 1 is the location of auxiliary gap 24. When the gap is located outside of the engine cylinder, not physically near the plasma igniter gap 26, the voltage at which the plasma conducts does not respond accordingly to variations in gas pressure within the cylinder or to turbocharger boost or throttle position. The result is wide variations in timing and a very conservative circuit must be designed to insure a plasma flow at all possible operating conditions for the engine. Additionally, the auxiliary gap itself is subject to erosion due to the high current discharge across the gap. A further disadvantage attributable to the auxiliary gap is the creation of large radiated E fields that must be shielded to prevent interference with other electrical systems of the vehicle and to prevent ignition hazards.

Engines for automotive applications operate over an extremely wide range of conditions. During start-up, for example, the air-fuel charge motion (characterized in terms of revolutions/minute or RPM) and the pressure inside the combustion chamber are significantly different than, for example, partial load cruising or full load acceleration. Three different sets of engine operating conditions are discussed below in relation to the requirements for an effective ignition source.

Start-up and idle: These operating conditions are characterized by relatively low in-cylinder pressure (80–150 psi) and air motion (300–900 rpm). In these conditions the breakdown discharge assumes, for example, a sinusoidal form similar to the curve A shown in FIG. 1A.

Full load acceleration: These conditions are characterized by much higher in-cylinder pressure (350–550 psi) and air motion (3000–6000 rpm). Under these conditions the breakdown discharge assumes a sinusoidal form that when compared to curve A shown in FIG. 1A, looks typically like curve B shown in FIG. 1B.

Figure 1A:
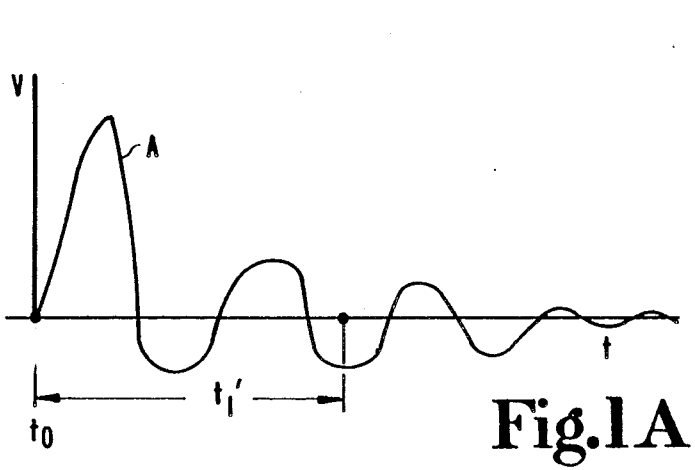
FIG. 1A is an illustration relating ignitor gap voltage to time during higher in-cylinder pressure and air motion.
Figure 1B:
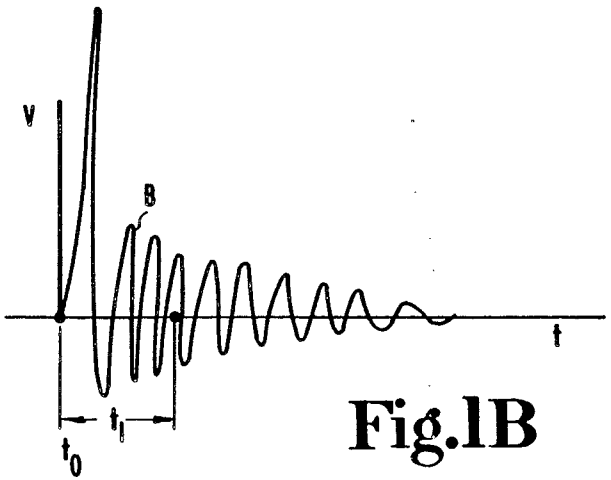
FIG. 1B is an illustration relating ignitor gap voltage to time during lower in-cylinder pressure and air motion parameters.
Figure 1D:
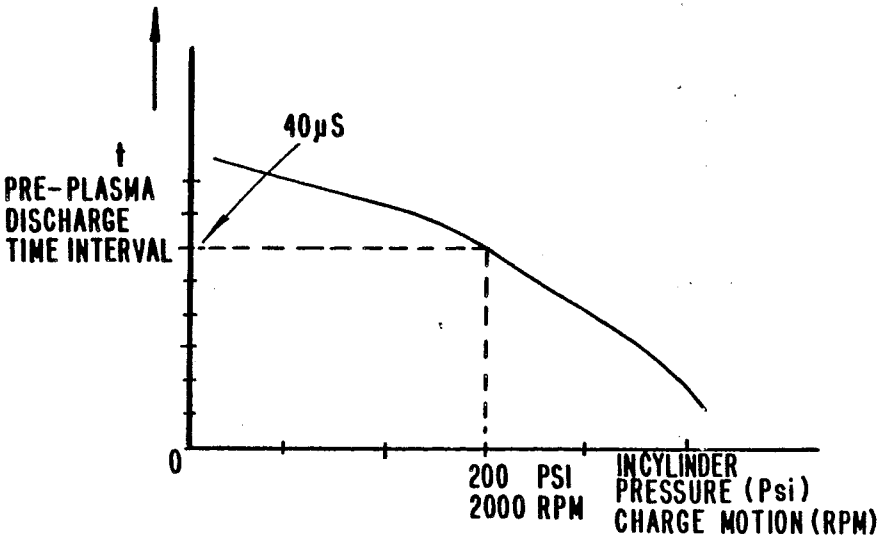
FIG. 1D is a graph relating the pre-plasma discharge time interval to in-cylinder pressure and charge motion.
Figure 1C:
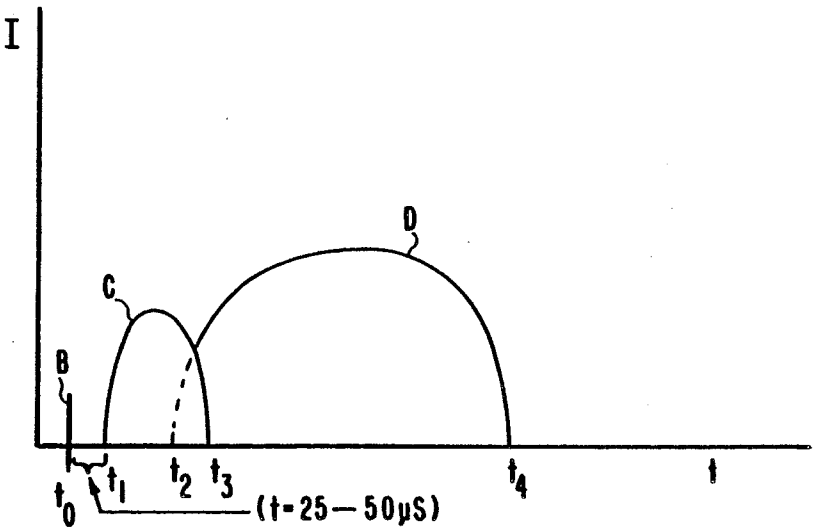
FIG. 1C is an illustration relating current to time and depicting a breakdown discharge signal, a pre-plasma discharge signal, and a main plasma discharge signal of a plasma ignition sequence.

Referring now to FIG. 1C, a typical plasma current discharge sequence for an apparatus according to the present invention is shown. The sequence includes an initial gap breakdown discharge B at time $t_0$, followed by a timed pre-plasma discharge C at time $t_1$ and by a main plasma discharge D at time $t_2$. Unlike the main plasma discharge timing, which is dependent upon the characteristics of the ionized channel, the beginning of the pre-plasma discharge C is timed with respect to the start of the breakdown discharge B. The time interval $t_1-t_0$ between these two events is varied according to the engine operating conditions to produce optimum engine performance or minimize emissions of pollutants.

If one defines $t_1$ as the time at which the discharge channel has the highest conductivity and therefore is the ideal timing for pre-plasma discharge, then as shown in FIGS. 1A and 1B, different engine operative conditions result in different values of t, i.e., $t_1$ is not equal to $t_1'$. Similarly, at part load cruising conditions, the in-cylinder pressure and charge motion values are somewhere in between the previous two cases and the value of t will be in-between $t_1$ and $t_1'$.

A qualitative representation of the relationship between the time interval $t_1$ to $t_0$ and the combustion chamber pressure and charge motion is shown in FIG. 1D. As the pressure parameter increases or the charge motion parameter increases, the voltage amplitude required to sustain the breakdown discharge ringing increases and the discharge period decreases as shown in FIG. 1B. In response to these conditions the value of $t_1$ is decreased. At lower pressure and slower charge motion conditions, the voltage required to sustain the breakdown discharge ringing is lower and the discharge period $t_1'$ is increased as shown in FIG. 1A. Lower pressure and slower charge motion conditions increase the time delay required between the breakdown discharge and the pre-plasma discharge for optimum engine operation is shown in FIG. 1A.

In order to vary the pre-plasma discharge time interval in relation to different engine operating conditions, it is necessary to vary from 0 to 200 microseconds the pre-plasma discharge time interval. Preferably the time interval is varied between 25 and 50 microseconds. This may be accomplished with a simple timing logic circuit responding to variations in a single sensed engine operating condition or parameter. At the opposite end of the spectrum, an Engine Control Unit (ECU) monitors various engine conditions and varies pre-plasma timing according to the engineering objective: maximize engine performance, reduction of emissions, or a combination of the two objectives. Similar technology is currently implemented to control spark timing, degree or amount of Exhaust Gas Recirculation EGR and the amount of fuel delivered for combustion in engines using conventional ignition systems.

Figure 1E:
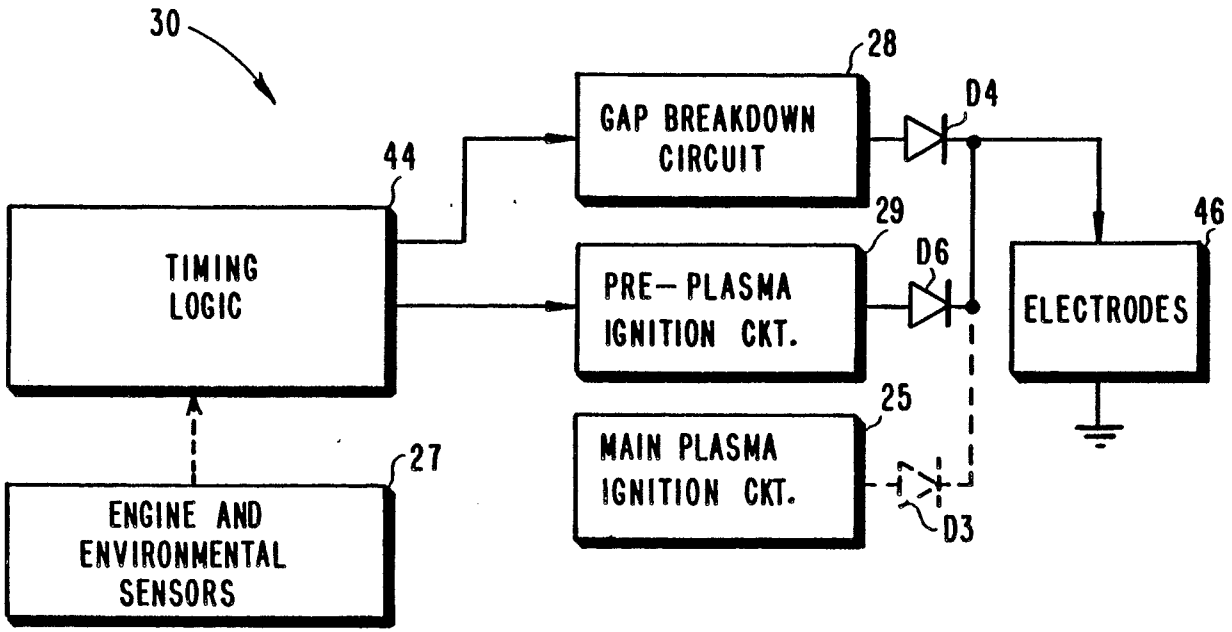
FIG. 1E is a block diagram for a conductive ionized channel producing system according to the present invention.

Referring now to FIG. 1E a black diagram of a plasma ignition system 30 according to the present invention is shown including the integration of the pre-plasma discharge timing control into a timing logic 44. It should be recognized that timing logic 44 is any circuit for varying timing logic signals, including an Engine Control Unit or computer.

Typically, all the fundamental parameters characterizing the engine operative conditions, are included in the ECU. These parameters are: intake conditions, spark advance desired, engine load, intake and exhaust temperatures, engine temperature, boost (either turbocharger or supercharger), ambient conditions and engine RPM. The memory of the ECU is loaded with all the functional relations between sensed engine operative conditions and engine controlling parameters (spark timing, EGR, fuel, etc.) for the pre-plasma discharge timing. The optimum pre-plasma discharge timing interval is defined as the time after start of breakdown discharge at which the discharge kernel presents the highest conductivity.

The ECU 44 produces timing signals to the gap breakdown circuit 28 and the pre-plasma ignition circuit 29, as a result of sensed engine and environmental signals from sensor block 27. (Sensors 27, main plasma circuit 25 and diode D3 are shown connected by broken lines to other system components to emphasize that these components of the system are optional, as shown by the embodiment of FIG. 2A.) Thus, the pre-plasma discharge always occurs when the breakdown discharge kernel presents the highest conductivity. The benefit of this method is in the capability to operate at the best consistency of discharge for any engine operative condition.

Figure 2:
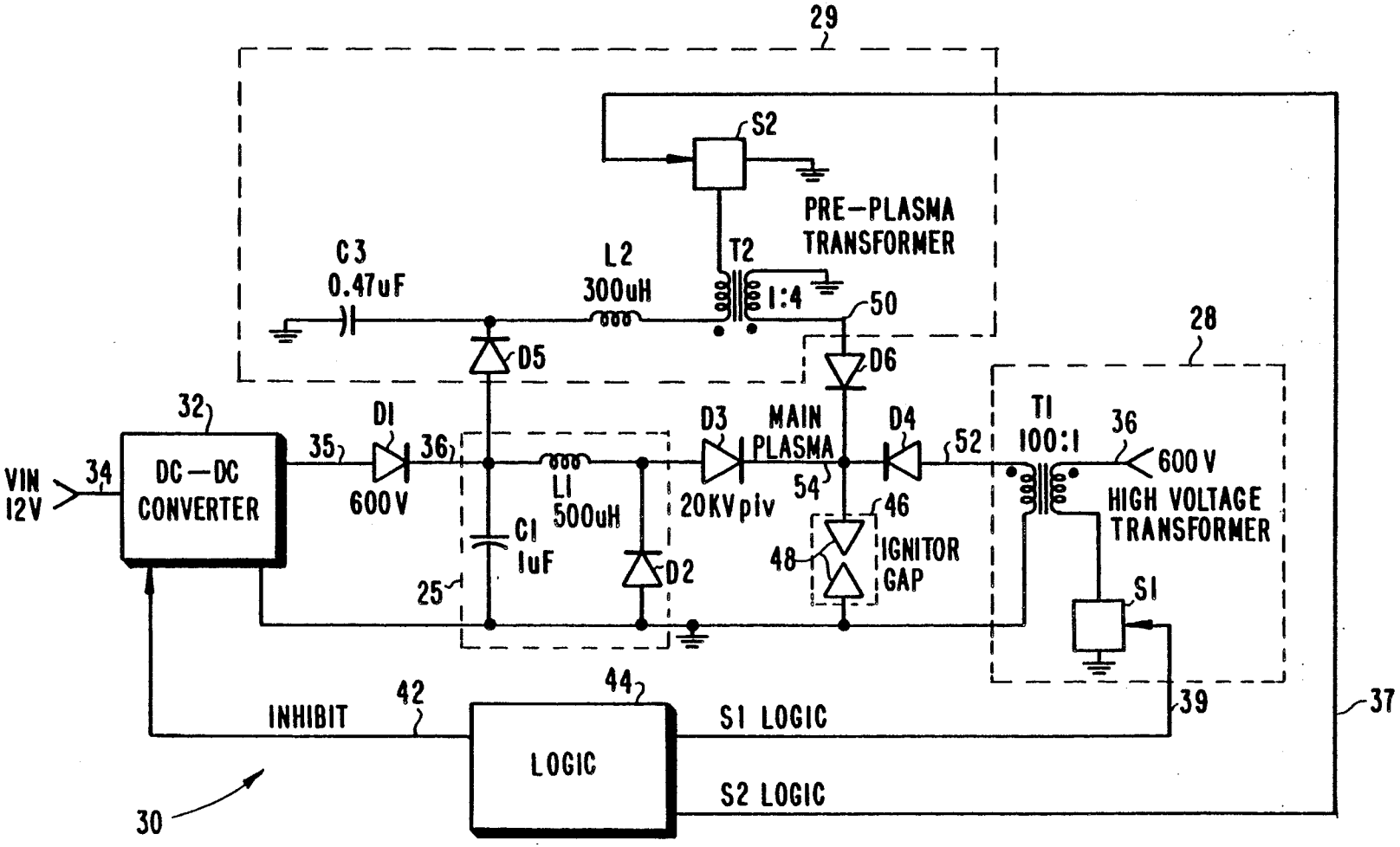
FIG. 2 is a schematic diagram for a conductive ionized channel producing circuit according to the present invention.
Figure 2A:
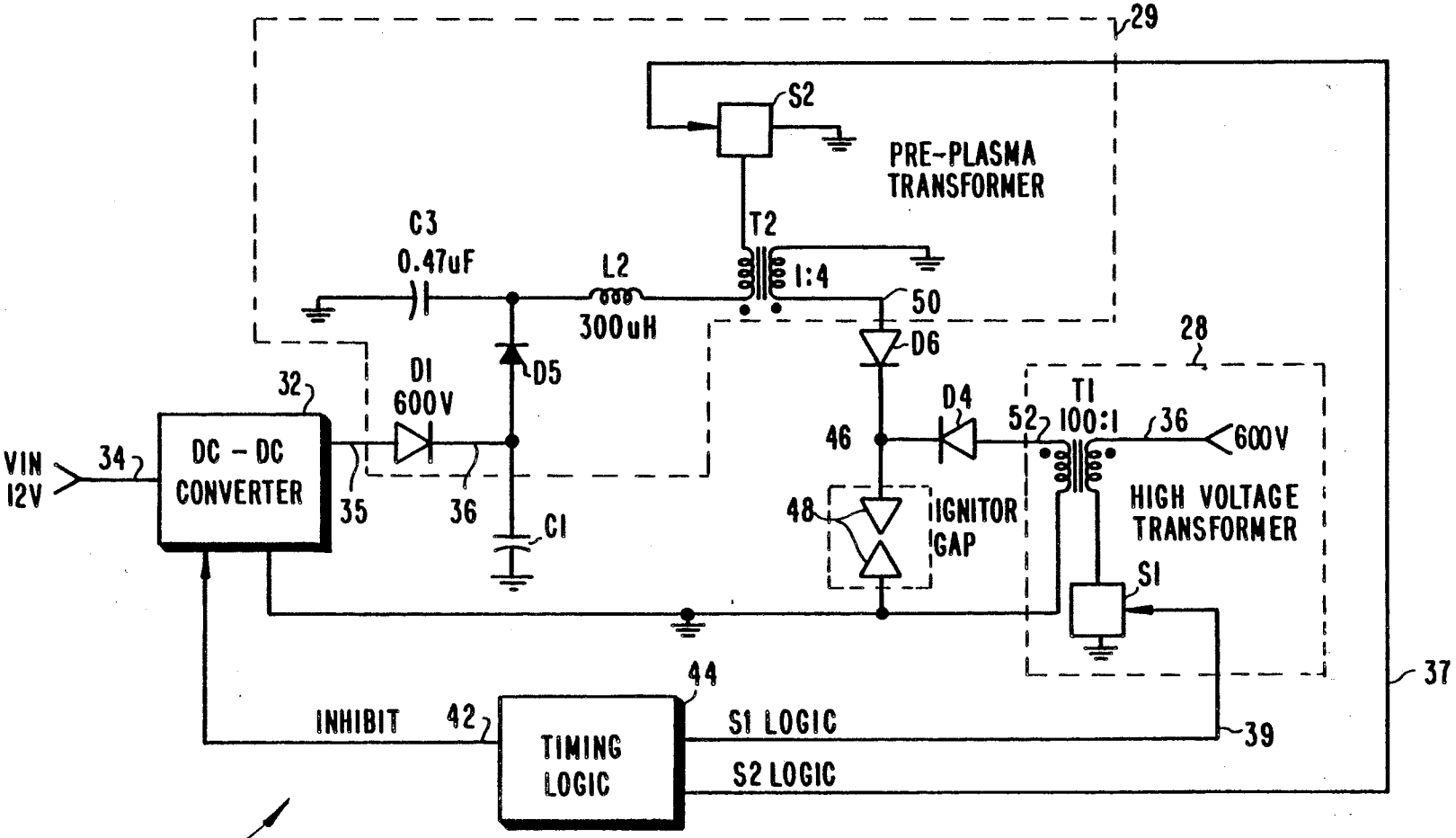
FIG. 2A is a schematic diagram of another conductive ionized channel producing circuit according to the present invention.
Figure 4:
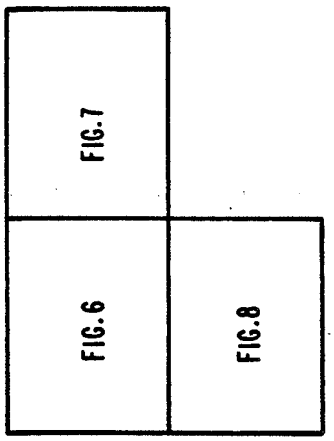
FIG. 4 is a diagrammatic illustration of the layout relationship of the electrical schematics of FIGS. 6, 7, and 8.

Referring now to FIG. 2, a schematic illustration of a circuit 30 for producing a highly conductive channel for the flow of plasma current according to the invention is shown. Voltage $V_{IN}$ is supplied to an input to DC-DC converter 32. Voltage $V_{IN}$ is normally, in a motor vehicle, 12 volts to 16 volts DC. The output of DC-DC converter 32, approximately 600 Vdc, is supplied to signal path 35 and to the primary of the high voltage transformer T1. This voltage is supplied to the anode of diode D1, an isolating device situated to prevent current flow from signal path 36 back into the output of DC-DC converter 32. The 600 volt output of DC-DC converter 32 is also supplied to capacitor C1, a one microfarad capacitor, and through diode D5 to capacitor C3, a 0.47 microfarad capacitor. The secondary winding of high voltage transformer T1 is coupled, via diode D4, to the ignitor gap 46. Similarly the secondary of the pre-plasma transformer is coupled to the ignitor gap 46 via diode D6.

Capacitors C1 and C3 charge up to the 600 volt level as a result of an output voltage from DC-DC converter 32. Logic circuitry 44 supplies three coordinated logic signals necessary to induce the plasma flow current across ignitor gap 48 contained within engine cylinder 46 diagrammatically illustrated by broken line form. Signal flow path 39, hereinafter referred to as signal 39, supplies switch S1 with a logic signal to force S1 to short the primary of transformer T1 to ground, or to open the primary of transformer T1 to an open circuit condition. Signal path 37, hereinafter signal 37, is connected to switch S2 which opens the primary of transformer T2 to an open circuit condition, or shorts the primary of T2 to signal ground. Signal path 42, hereinafter signal 42, is an inhibit signal supplied to the DC-DC converter 32, to turn the output voltage signal 35 of the DC-DC converter off during the plasma event.

Operationally, the initial step in the plasma flow ignition sequence takes place when switch S1 is switched from the open to the closed position, thereby inducing a voltage spike into the secondary winding of transformer T1. The signal produced at the secondary of transformer T1 on signal path 52 is supplied through diode D4 to signal path 54 connected to igniter gap 48. The initial high voltage signal supplied from transformer T1 will result in a voltage arc or spark across igniter gap 48 once the voltage across the gap builds up to approximately 25 kilovolts. After a predetermined time after the closing of switch S1, switch S2 is closed by logic circuit 44 thereby providing a discharge path for the energy stored in capacitor C3 through inductor L2, the primary of transformer T2, and through switch S2 to signal ground. The signal induced in the secondary of transformer T2 builds up to a voltage level, which exists at signal path 54 as a result of the spark voltage across the gap 48, until the voltage at signal path 50 exceeds the gap voltage, resulting in diode D6 having a forward bias voltage applied from anode to cathode. Thereafter the pre-plasma transformer T2 converts from a voltage source to a current source and begins to supply current to the igniter gap 48 thereby inducing a pre-plasma current to flow across igniter gap 48. After diode D6 is biased to conduct current, transformer T2 becomes a current transformer in operation, supplying current to the ignitor gap 48. The pre-plasma current flow induced at igniter gap 48 flows for approximately 40 microseconds, long enough to open a highly conductive channel across the gap. The current supplied by transformer T2 is described as a "pre-plasma" current signal because the current pulse precedes the main plasma signal, reducing the required voltage for the main plasma current to flow.

When the pre-plasma transformer T2 is activated by way of switch S2, a current pulse delivered through diode D6 to signal path 54 creates a conductive ionized channel between the electrodes of igniter gap 48. This pre-plasma current reduces the voltage necessary for the plasma flow to take place, hereafter referred to as the sustaining voltage, thereby allowing diode D3 to become forward biased as the voltage at signal path 54 now has dropped to a voltage in the area of 200 to 400 volts. Once diode D3 is forward biased, the energy stored in capacitor C1 is discharged through inductor L1 and diode D3 to the signal path 54 thereby supplying the main plasma current to the igniter gap 48. Diode D2 allows circulating inductor currents after the arc is extinguished, and is rated at 1,000 volts breakdown voltage. Diode D4 is rated at 30 Kvolts and prevents transformer secondary current flow while the ignition coil or transformer T1 is storing energy, and during the negative voltage excursions of T1. Note that D4 can be deleted if an auxiliary gap inherent in a typical mechanical distributor-based spark system is present to isolate transformer T1 from the ignitor gap 46. The pulse shaping inductor L1 is connected by means of series diode D3 to the plasma igniter gap 48. Diode D5 allows the DC-DC converter to operate without discharging capacitor C3, while diode D6 isolates the pre-plasma circuit of transformer T1, capacitor C3, and inductor L2 from the high voltage circuit of signal path 54.

Referring now to FIG. 2A, an alternate schematic illustration of a circuit 31 for producing a highly conductive channel for the flow of plasma current according to the present invention is shown. This circuit is identical in all respects as compared to the circuit of FIG. 2 with the differences being the elimination of inductor L1, and Diodes D2 and D3. Again diode D4 can be replaced by the auxiliary gap of a typical distributor/rotor arrangement common to most multi-cylinder internal combustion engine ignition systems thereby isolating and coupling transformer T1 to the ignitor gap.

Operationally, the embodiment shown in FIG. 2A functions similarly to the embodiment of FIG. 2 with the exception of a main plasma discharge signal supplied to the ignitor gap 46. By eliminating the circuitry associated with the main plasma ignition circuit shown in FIG. 1E as element 25, the device is simplified. It can be expected in certain applications of the plasma forming circuit of FIG. 2A that the plasma signal delivered from transformer T2 via diode D6 into the ignitor gap 46 will be sufficient to initiate ignition of an air-fuel mixture. The plasma ignition system 31 of FIG. 2A corresponds to the blocks 44, 28, 29, and 46 of FIG. 1E.

Figure 3:
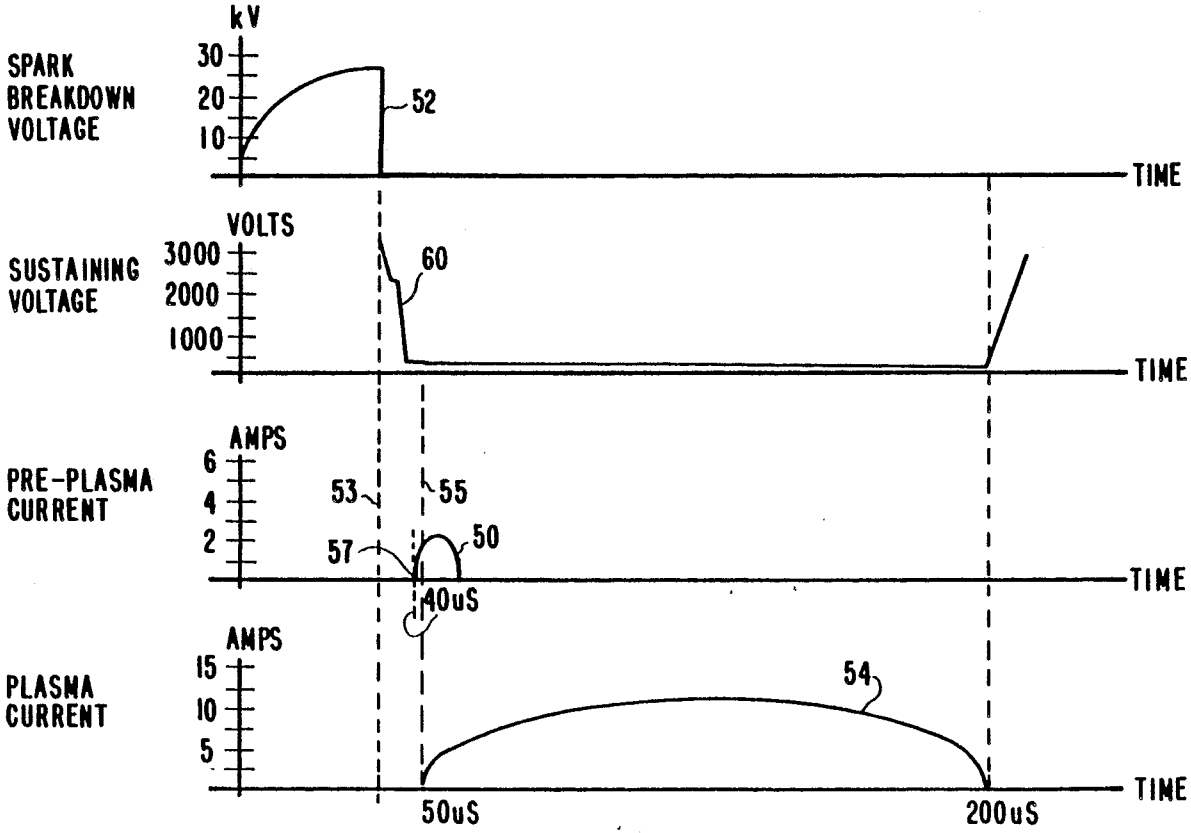
FIG. 3 is an illustration relating spark breakdown voltage, sustaining voltage, pre-plasma current, and main plasma current versus time.

Referring now to FIG. 3, a diagrammatic illustration of the spark breakdown voltage present on signal path 52 and labeled similarly, sustaining voltage curve 60, pre-plasma current signal of signal path 50, and main plasma current signal of signal path 54 are graphically related versus time. As is shown in FIG. 3, the required voltage for initiating plasma flow, i.e. the sustaining voltage, across the igniter gap 48 of FIG. 2 drops dramatically once the spark breakdown voltage signal 52 drops from 25,000 to approximately 500–3,000 volts indicating that a voltage spark exists across the ignitor gap electrodes. The time delay from time line 53 to the beginning of the pre-plasma current flow at 57 is determined by various factors which affect the spark breakdown voltage, such as cylinder pressure, cylinder temperature, and the size of the ignitor gap. Typically, the pre-plasma current 50 is delayed until after the time which is the theoretical maximum possible delay which can occur prior to the spark breakdown voltage dropping from 25,000 to approximately 500–3,000 volts. The short duration, approximately 40–50 microseconds, pre-plasma current pulse flows across the igniter gap 48 in the ionized channel created by the voltage spark. The pre-plasma current flow creates a low impedance conducting channel across the igniter gap. As a result of the pre-plasma current pulse signal 50, the sustaining voltage across the gap is reduced to a consistent value of approximately 200–400 volts.

Since the sustaining voltage of 400 volts is less than the main plasma voltage of 600 volts present on capacitor C1, the main plasma current flows in the channel from the energy stored in capacitor C1 of FIG. 2. Thus, the required main plasma voltage is reduced from 3,000 volts to less than 600 volts without loss of performance. By delaying the pre-plasma current signal until after the voltage spark occurs, within 20 microseconds after time line 53 of FIG. 3, the volt-second capability of transformer T2 is reduced because voltage is not applied to the primary of T2 while the spark voltage is being created and stabilized. Thus, cost advantages and size reductions are gained with respect to transformer T2. The volt-seconds capability of transformer T2 is directly related to flux storage capability of the transformer, which in turn directly impacts transformer winding and core size. By realizing a reduction in the volt-seconds output requirement for transformer T2, a smaller, less expensive transformer can be used to generate the pre-plasma flow.

When switch S2 shorts the primary of transformer T2 of FIG. 2 to ground, and 100 milliamps to 500 milliamps of current flows from transformer T2 through diode D6, the sustaining voltage for main plasma flow is reduced to approximately 200 to 400 volts. In actuality, the disclosed circuit will supply anywhere from one to three amps from the secondary of transformer T2 through diode D6 to the ignitor gap 48.

The circuits of FIG. 2 and FIG. 2A can be used with a multi-cylinder engine. A distributor device inserted into the circuit between the circuit junction of diodes D3, D4 and D6, and ignitor gap 48 provides distribution of the plasma ignition signal to all ignitor gap devices. A typical 4-cylinder 4-stroke engine operating at 3,000 RPM requires a 50 hertz firing signal. Frequency of firing directly affects the power requirements of the DC-DC converter 32 and dictates whether a single plasma ignition circuit coupled with a distributor verses individual plasma ignition circuits is more cost effective in a particular engine configuration. As an example of power requirements placed on the DC-DC converter, charge time of capacitors C1 and C3 is approximately 5–7 milliseconds if a DC-DC converter of approximately 15W output capability is used.

The embodiment of the invention shown in FIG. 2 circumvents the problem of producing a high current, high voltage signal from the same transformer. The circuit instead employs two separate transformers, one producing the high voltage electrode gap breakdown voltage, the second transformer T2 producing the pre-plasma current signal. By using two different transformers, the need for both a large number of turns for high voltage, and large gauge for sufficient current for a low impedance plasma channel in a single device is eliminated.

It is generally recognized that the volume of transformer T2 will increase linearly with the period of time required to sustain a 3,000 volt signal across the ignitor gap. This is best described by relating the volt-second capability of the transformer to the volume of the transformer. The embodiment of the invention reduces the volt-seconds requirements for transformer T2 by delaying the application of voltage to the primary of T2 until after the electrode gap breakdown has occurred. This is accomplished by the S2 logic 37 which delays turn on of S2 until a preset period of time has elapsed from S1 turning on. By delaying logic S2 for this interval, the total time, and thus the total volt-seconds required of transformer T2 is reduced.

It is also recognized and well known in the art that a capacitor on the output of transformer T1 could supply the current pulse necessary to reduce the electrode gap impedance to a value low enough to induce plasma flow, however, erosion of the ignitor electrodes will result because the di/dt component is quite high with a capacitor across the output of transformer T1. Advantageously, the pre-plasma transformer circuit also extends ignitor gap or spark plug life as opposed to the prior art circuits for plasma ignition using a capacitor as the primary power storage device for initiating plasma flow.

An inhibit signal supplied by way of signal path 42 to an input of DC-DC converter 32 provides a logic control signal to converter 32 inhibiting the output of the converter 32 during the period that capacitor C1 is discharging the stored energy through conductor L1 and diode D3 into the ignitor gap 48. The purpose behind inhibiting the converter 32 is to protect the output driver devices of converter 32 from attempting to maintain the converter output voltage at a 600 volt level at a point in time when the load seen by the output of the converter 32 is a low impedance. If the output of converter 32 were not inhibited, the converter 32 would attempt to maintain the output at signal path 35 at 600 volts at all times. Once the sustaining voltage necessary to maintain plasma flow has dropped to 200 to 400 volt range, the converter 32 will attempt to supply additional current in order to raise its output voltage to 600 volts, thereby resulting in a strong likelihood of a continuous plasma flow with subsequent damage to the output driver devices within converter 32, and premature erosion of the electrodes.

Figure 5:
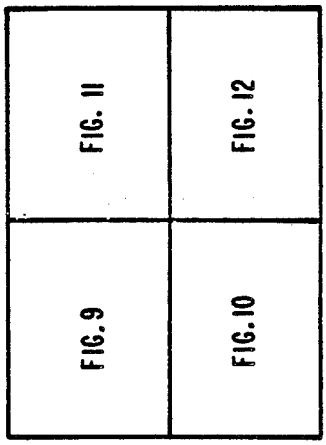
FIG. 5 is a diagrammatic illustration of the layout relationship of the electrical schematics of FIGS. 9, 10, 11, and 12.
Figure 6:
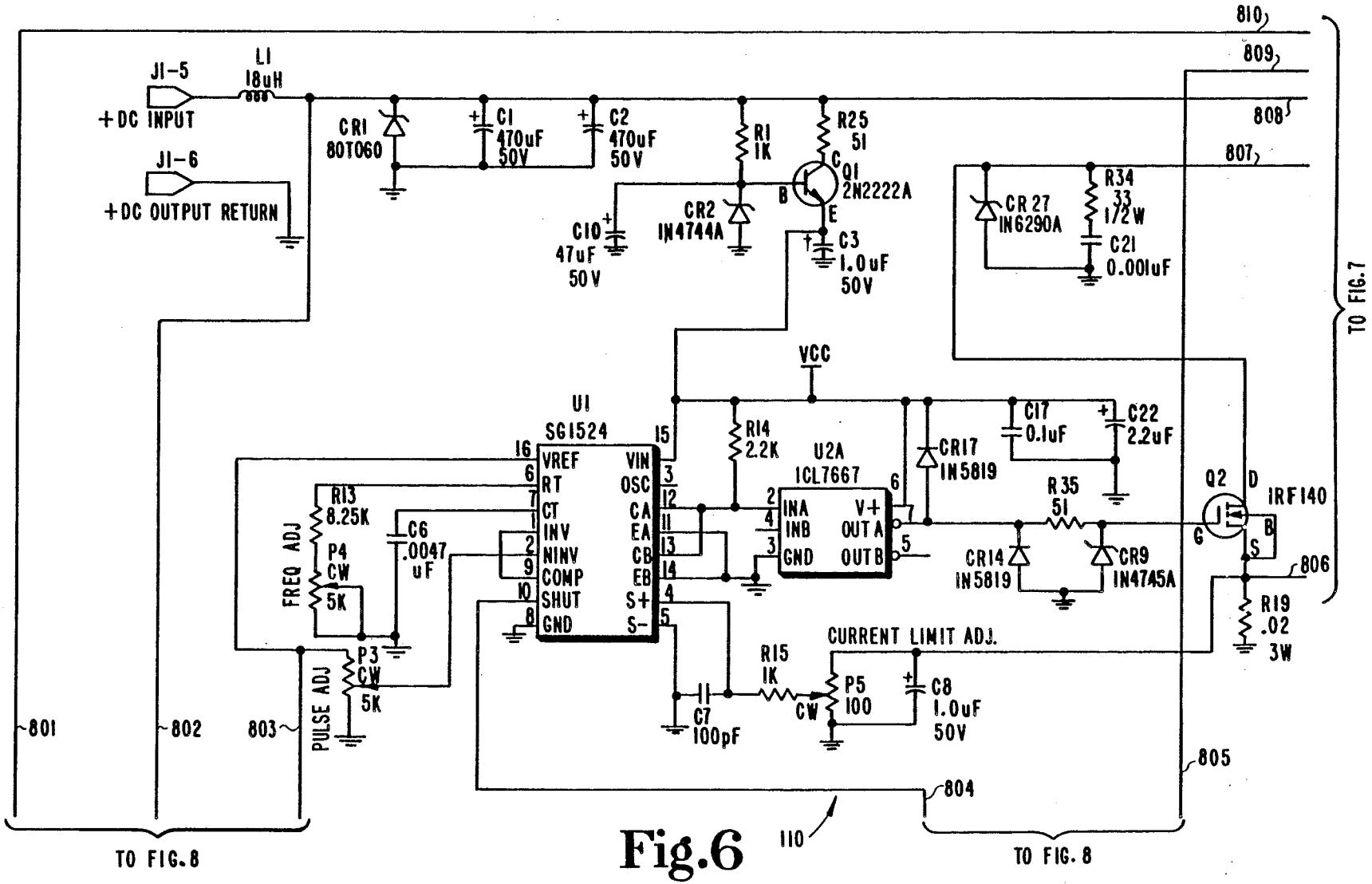
FIGS. 6–8 are an electrical schematic of a main-plasma circuit according to the present invention.
Figure 7:
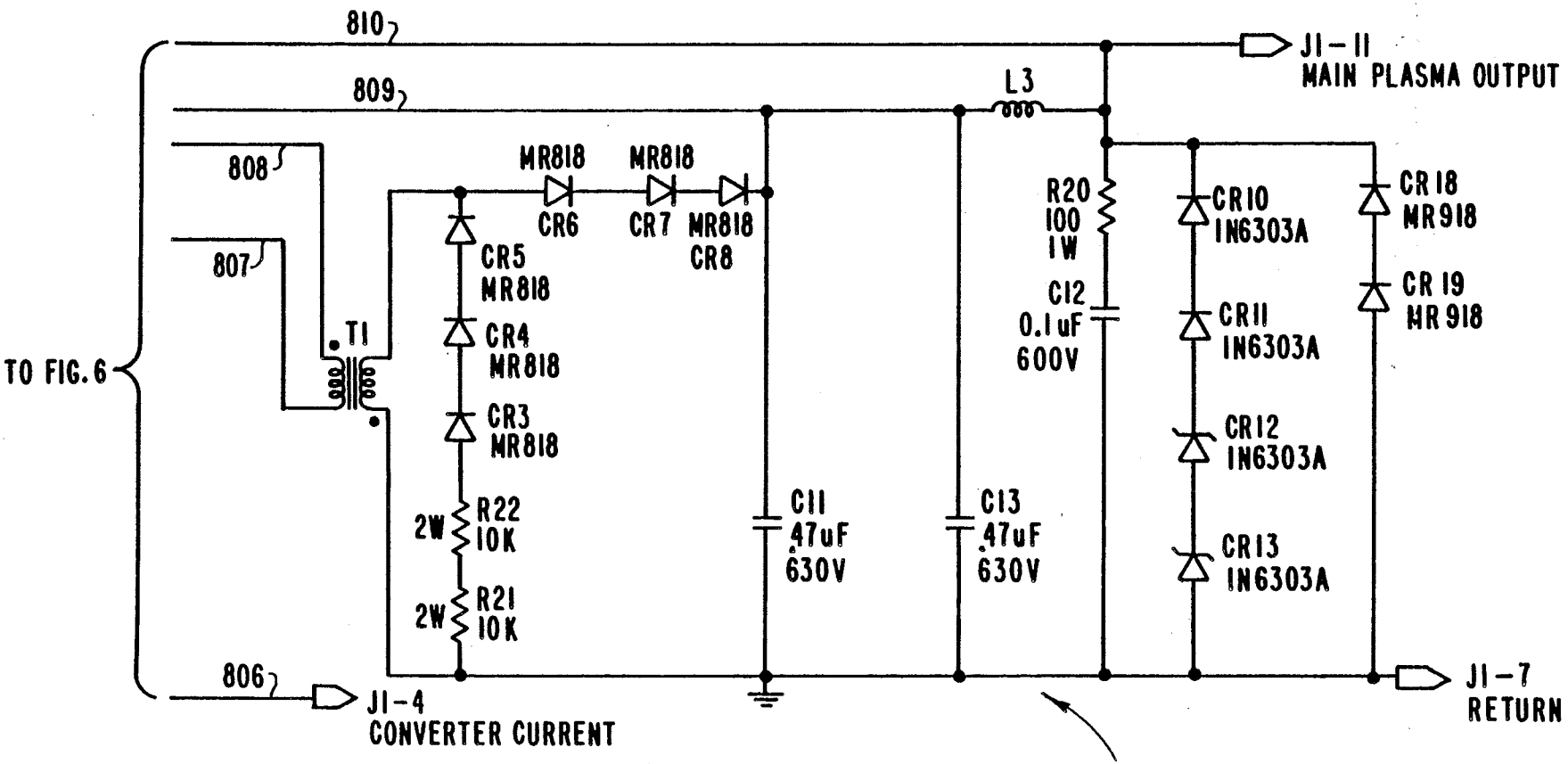
Figure 8:
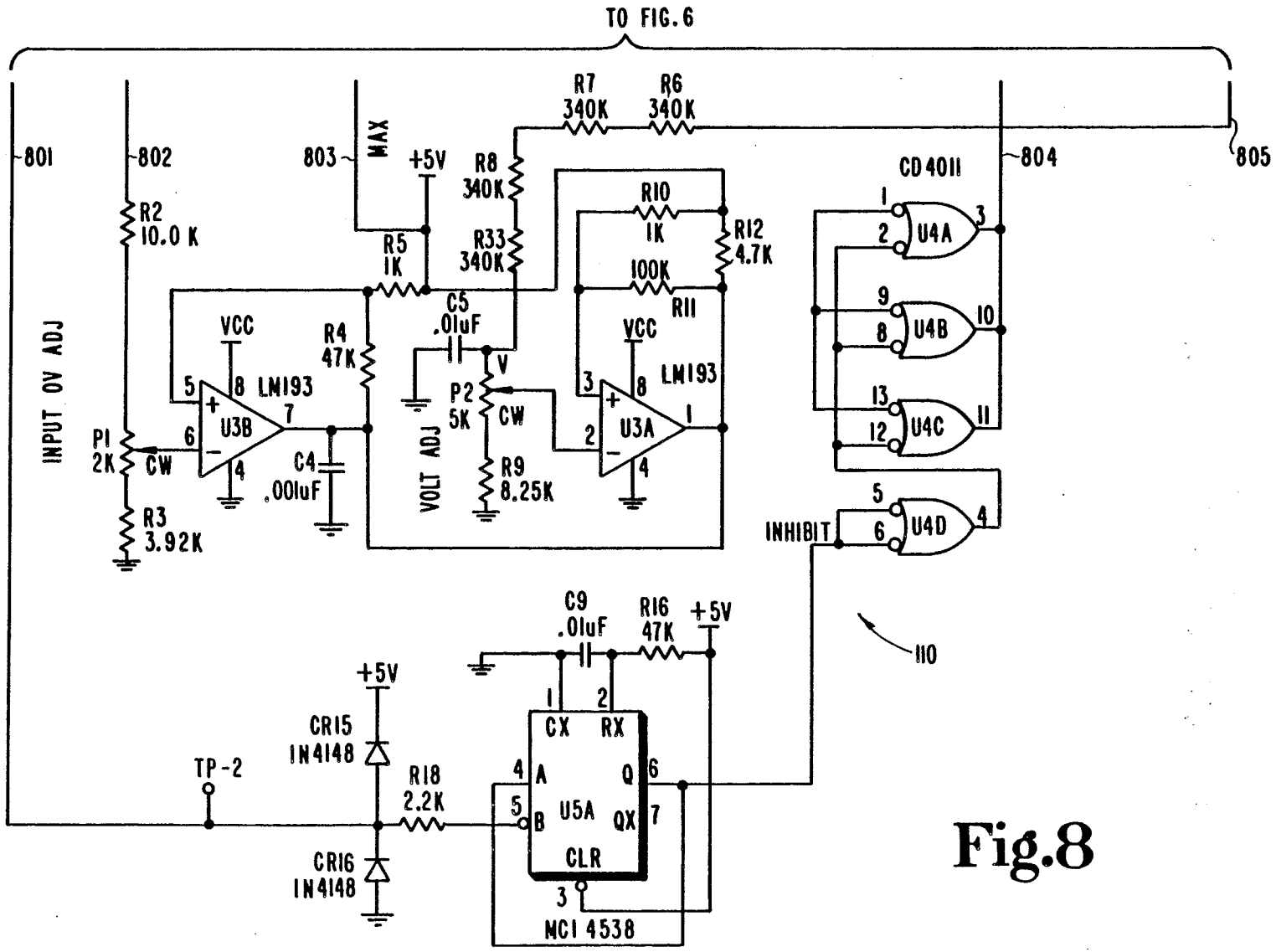

Another embodiment of a circuit 100 (see FIG. 13) for generating a highly conductive channel for the flow of plasma current according to the present invention is shown in FIGS. 6–13. As shown in FIG. 4, FIGS. 6, 7, and 8 may be positioned according to the diagram in FIG. 4 in order to view the entire circuit 110 for producing main plasma flow. Similarly, FIG. 5 diagrams the arrangement of FIGS. 9, 10, 11, and 12, which together show a circuit schematic for the pre-plasma circuitry 120. The circuitry shown in FIGS. 6, 7, and 8 comprises the main-plasma circuit 110 and is a completely separate and independent circuit from the circuitry for the pre-plasma circuit 120 shown in FIGS. 9–12. Symbols used for components of the circuitry of FIGS. 6–8 are not related to those used in the circuitry of FIGS. 9–12. Thus, the symbol "R1" for a resistor may appear more than once in FIGS. 6–12, however each use of "R1" refers to a new component if used in a different figure. Component values, tolerances, IC part numbers, and voltage ratings are indicated on the schematics of FIGS. 6–12 in close proximity to the corresponding circuit component.

Referring now to FIGS. 6, 7, and 8, an electrical schematic for the main-plasma circuit 110 according to the invention is shown. DC input power for the circuit is supplied at connections J1-5 and J1-6 of FIG. 6. Main-plasma output current is supplied to an ignitor gap, shown in FIG. 13, from connection J1-11 of FIG. 7. Connection J1-7 provides a return path for the main-plasma output signal produced at connection J1-11 of FIG. 7. Referring to FIG. 6, DC input power is regulated by device Q1 and the associated passive component circuitry connected with Q1. At the plus side of capacitor C3, the regulated DC voltage is supplied to pin 15 of device U1, a DC-DC converter controller IC. Transformer T1 and integrated circuits U2A, U3A, U3B, and Q2 and the associated passive components connected to these devices comprise the DC-DC converter circuitry for producing 600 volts DC at the junction of inductor L3 and capacitor C13 of FIG. 7.

The main-plasma output signal at connection J1-11 is connected to input pin 5 of monostable multivibrator device U5A through resistor R18 in FIG. 8. Device U5A provides an inhibit output signal to the input of OR gate U4D. The buffer device U4D is connected to the inputs of devices U4A, U4B, and U4C. Parallel output connections of OR gates U4A, U4B and U4C provide sufficient current drive capability, CMOS to an input pin 10 of device U1 to inhibit the output of device U1 in FIG. 6.

Resistor R16 and capacitor C9 connected to device U5A control the width of the inhibit pulse produced at the output pin 6 of device U5A in FIG. 8. In particular, the positive pulse produced at output pin 6 of U5A will be approximately 470 microseconds. The pulse produced at output pin 6 of device U5A will inhibit the DC-DC converter output signal for 470 microseconds, the period of time corresponding to the maximum duration of current flow from connection J1-11 of FIG. 7 to the ignitor gap 126 of FIG. 13.

Figure 13:
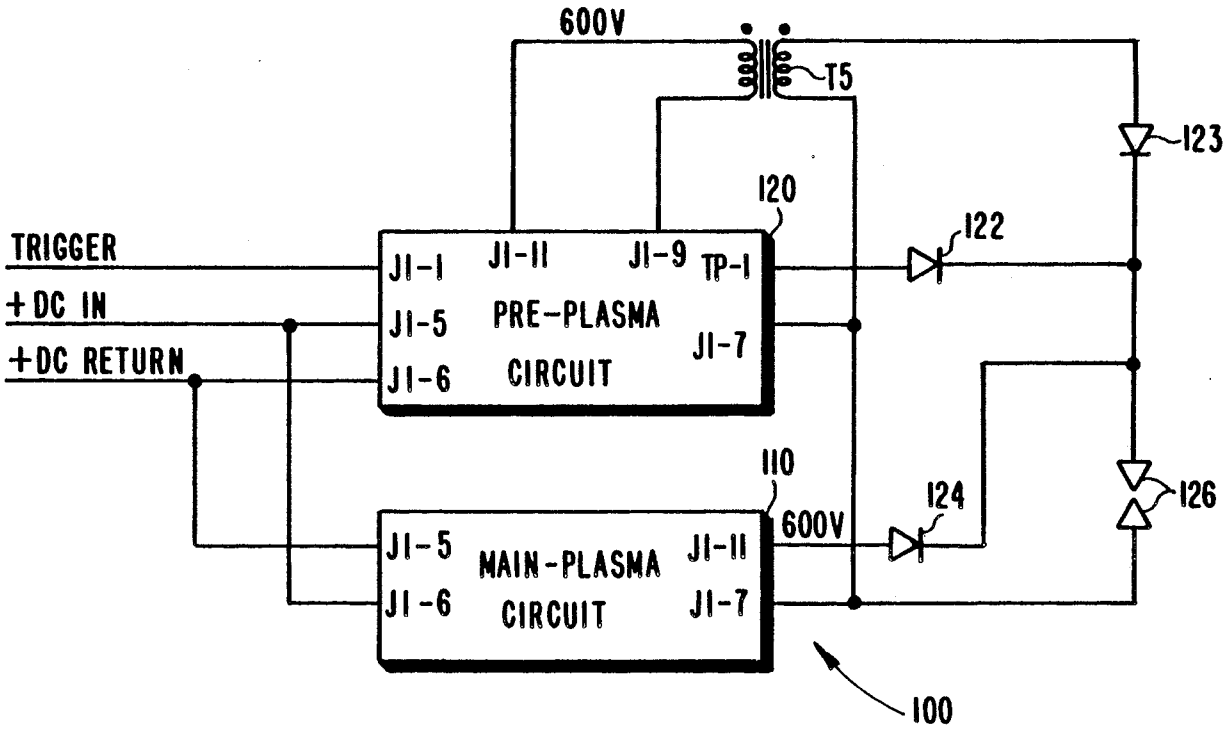
FIG. 13 is a schematic illustration of another embodiment of a plasma ignition circuit according to the present invention illustrating the interconnections between an ignitor device, the pre-plasma circuit of FIGS. 6–8, and the pre-plasma circuit of FIGS. 9–12.

Operationally, the main-plasma circuit of FIGS. 6–8 provides a source of current for main plasma flow in the ignitor gap 126 of FIG. 13 once a highly conductive ionized channel has been created across the ignitor gap 126 of FIG. 13. When the voltage at connection J1-11 of FIG. 7 drops to a voltage near 200–400 volts, the falling-edge-triggered input pin 5 of device U5A in FIG. 8 is triggered disabling the DC-DC converter at U1 of FIG. 6 for the 470 microseconds as determined by capacitor C9 and resistor R16 of FIG. 8. After 470 microseconds has expired, output pin 6 of device U5A in FIG.

8 will again fall low thereby enabling the output of DC-DC converter controller U1 in FIG. 6 and thus recharging storage capacitors C11 and C13.

Figure 9:
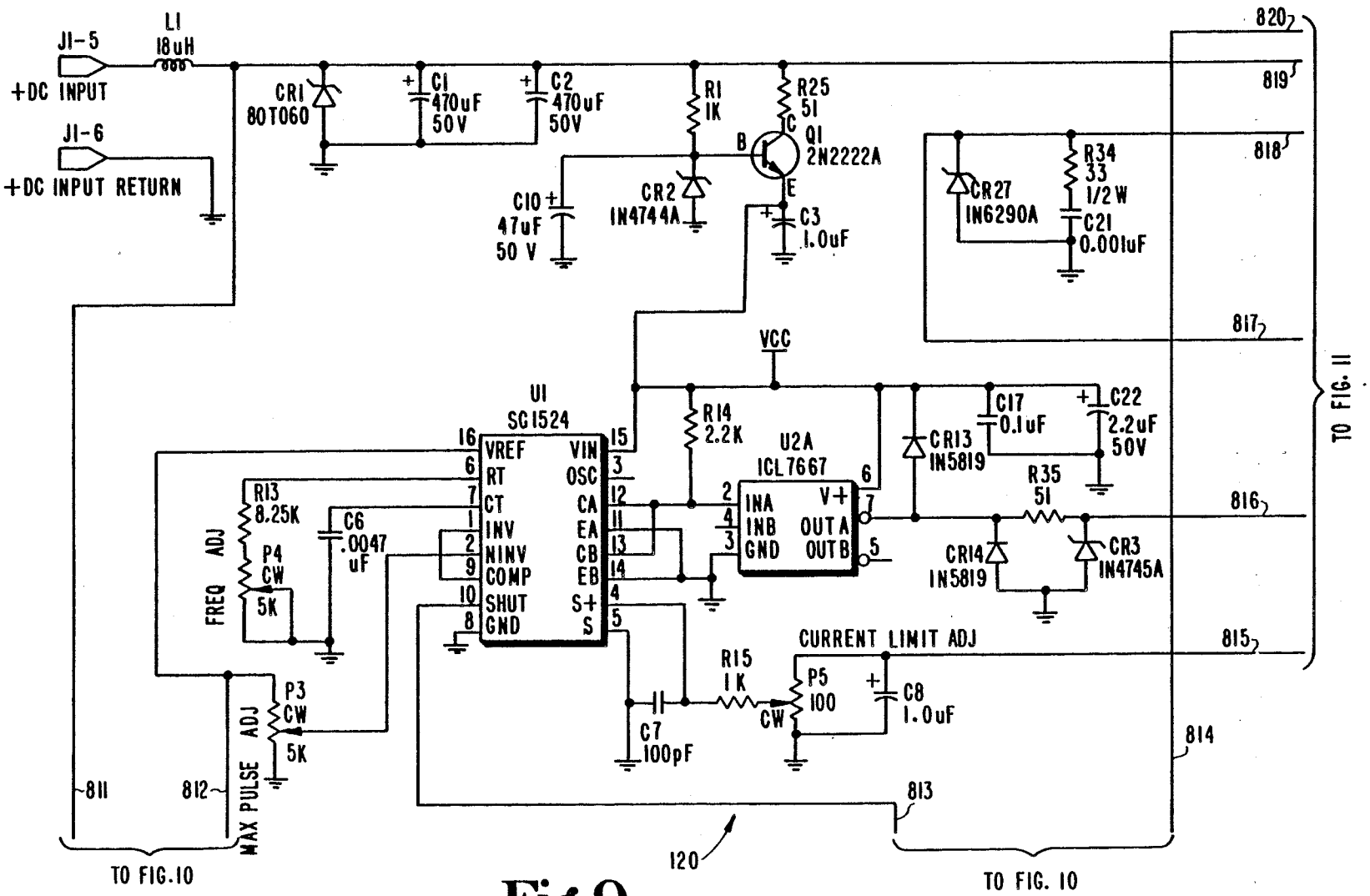
FIGS. 9–12 are an electrical schematic of a pre-plasma circuit according to the present invention.

Referring now to FIGS. 9–12, a pre-plasma circuit 120 according to the invention is shown. DC power is supplied to the pre-plasma circuit board at connections J1-5 and J1-6 of FIG. 9, with the positive voltage at J1-5 and the signal ground or DC input return at connection J1-6. Device Q1 and the passive components connected to it provide a voltage regulation function for the voltage VCC. A DC-DC converter circuit for producing a high DC output voltage from the low DC input voltage supplied to connection J1-5 of FIG. 9 is comprised of the following active devices and associated passive components connected thereto: U1, U2A, Q2 of FIG. 11, U3A and U3B of FIG. 10, and transformer T1 of FIG. 11. Regulated DC voltage from device Q1 is supplied to input pin 15 of device U1, a DC-DC converter controller IC. High frequency switching of the primary winding of transformer T1 in FIG. 11 via high power FET device Q2, induces very high voltage signals at the output of transformer T1 connected to diodes CR5 and CR6. The 600 volt output is isolated by diodes CR6, CR7, and CR8, and is supplied to capacitor C11 a charge storage device and through CR11 and CR12 to capacitor C13, a charge storage device.

Figure 10:
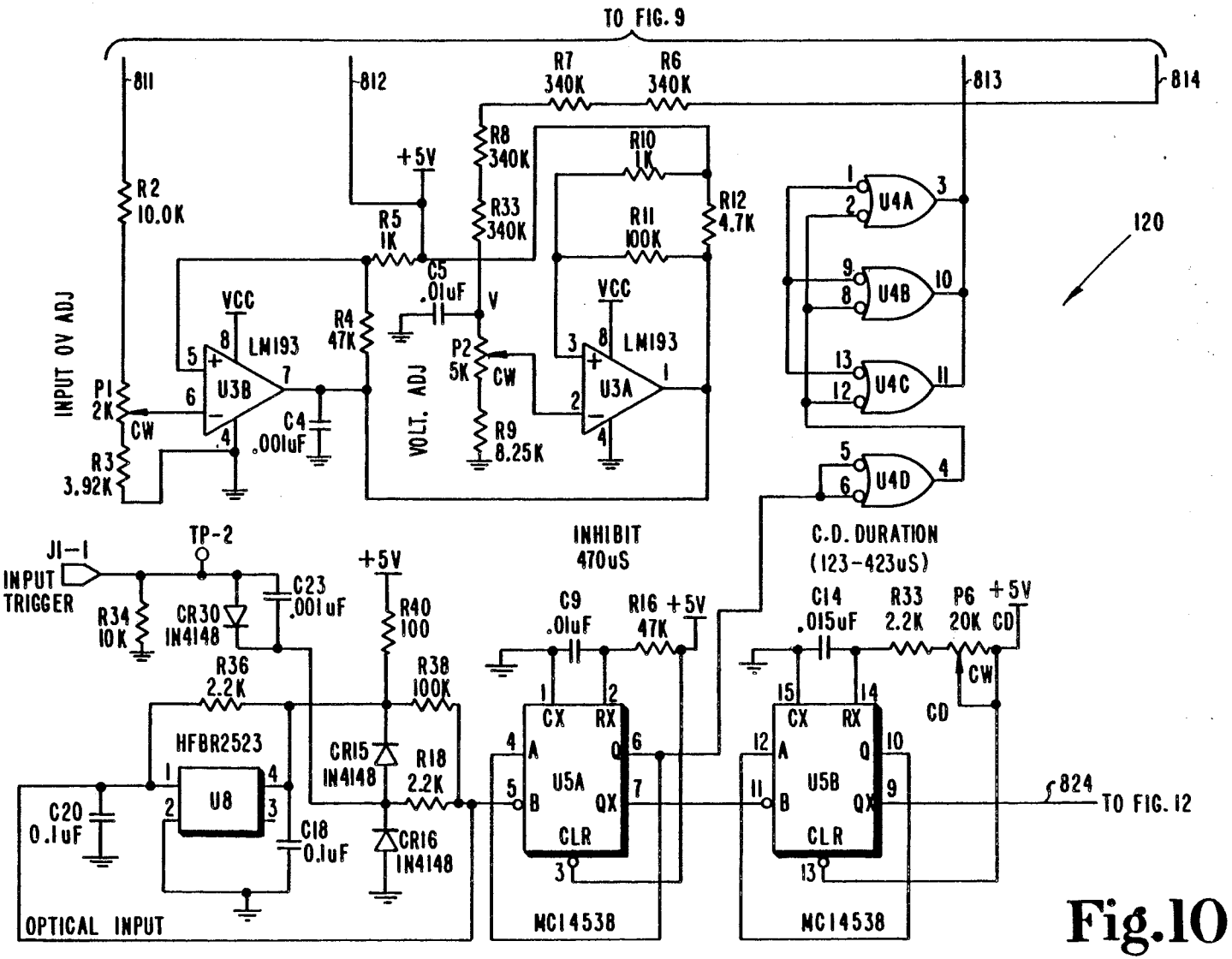
Figure 11:
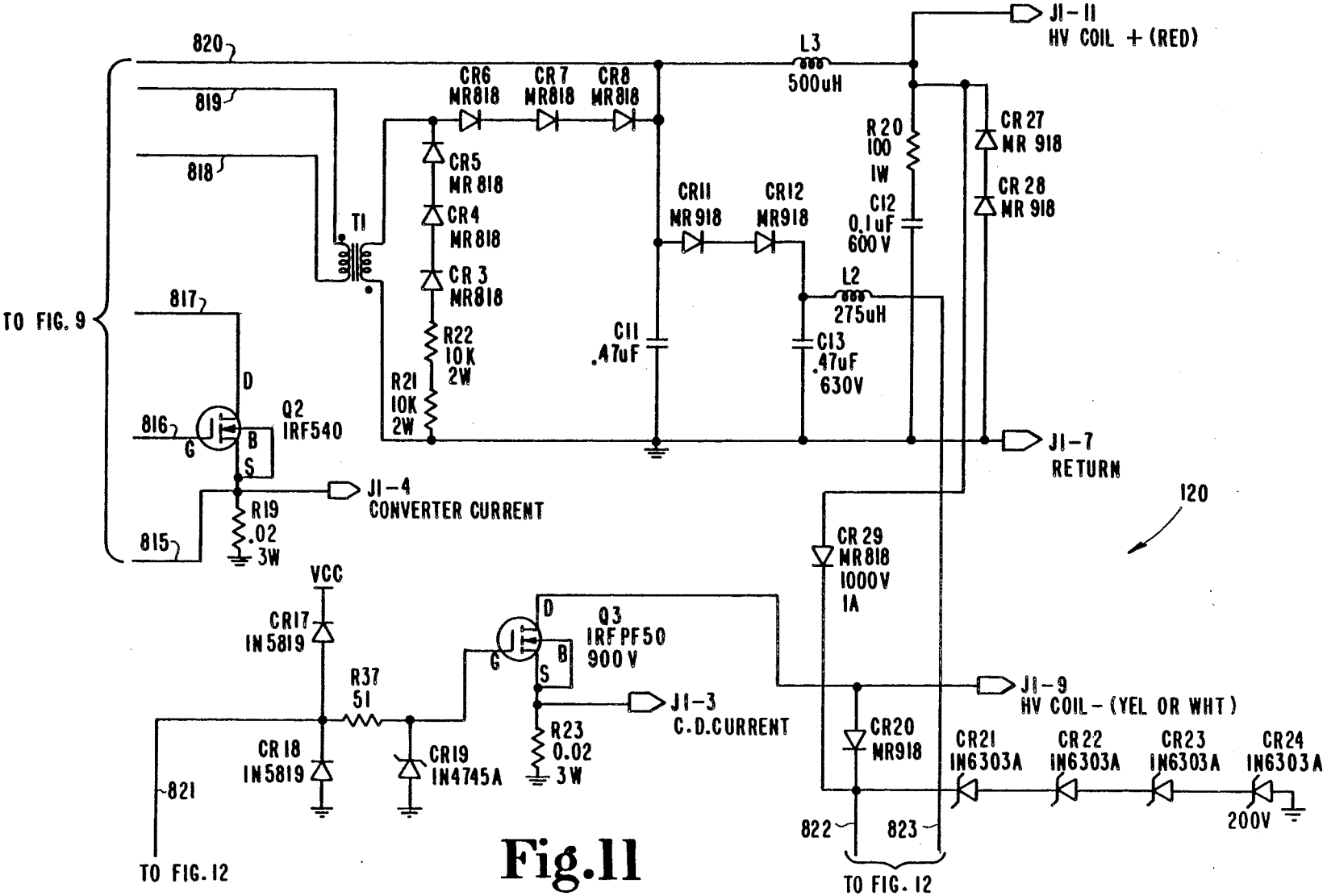
Figure 12:
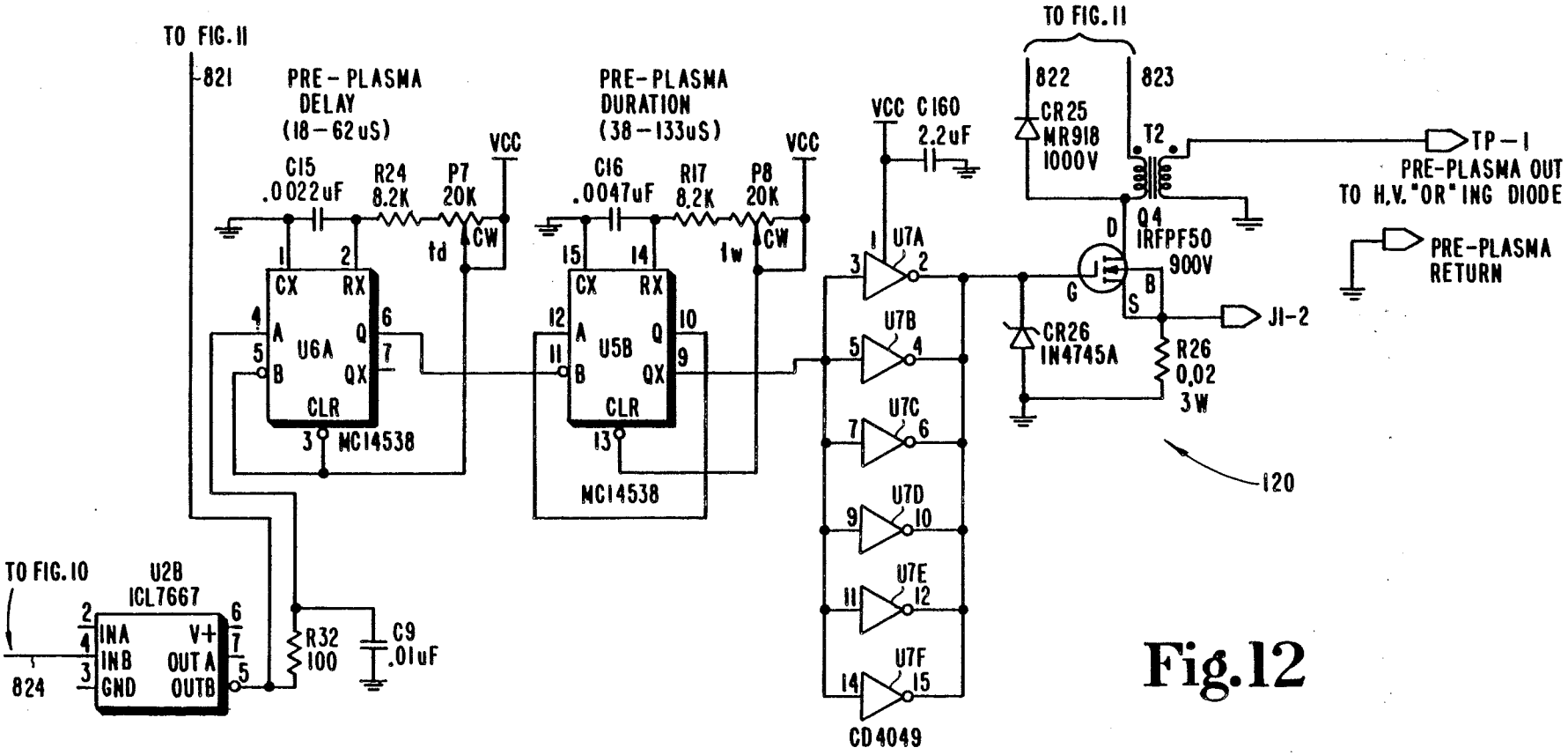

Functionally speaking, a trigger signal supplied by an external device to connection J1-1 of FIG. 10, or supplied to optical coupling receiver U8 in FIG. 10, initiates the plasma ignition sequence. An input trigger signal will initiate a pulse output from the non-retriggerable monostable multivibrator device U5A in FIG. 10. The pulse signal produced at the output of device U5A at pins 6 and 7 is a 470 microseconds pulse which inhibits the output of device U1 of FIG. 9 through buffer devices U4A, U4B, U4C and U4D, thereby preventing any harm to the DC-DC converter output circuitry while the plasma flow sequence is in process. At the same moment in time that the DC-DC converter is disabled, a second non-retriggerable monostable multivibrator U5B is triggered and a low-going pulse is produced at pin 9 of device U5B in FIG. 10, thereby triggering device U2B in FIG. 12 and Q3 of FIG. 11 to turn on thereby immediately initiating current flow through the primary coil of a high voltage transformer connected to connection J1-9 of FIG. 11 as illustrated in FIG. 13, by transformer T5. The low-going pulse at U5B pin 9 of FIG. 10 is 123–423 microseconds in duration. The closing of the primary of transformer T5 in FIG. 13 produces a high voltage signal in the secondary winding of T5 as capacitors C11 and C13 discharge through transformer T5. The high voltage signal is supplied to the anode of diode 123 and thereafter appears at ignitor gap 126. The primary of transformer T5 in FIG. 13 is connected to ground through connection J1-9 of the pre-plasma circuit 120 for a period determined by capacitor C14 and resistor R33 of FIG. 10, or approximately 123 to 423 microseconds. An output signal from device U2B, an FET driver device, also supplies an input signal to the positive-edge-triggered input pin 4 of device U6A of FIG. 12. Device U6A provides an 18 to 62 microsecond signal delay prior to activation of the pre-plasma multivibrator timer device U5B. As the output pin 6 of U6A of FIG. 12 falls low, the low going edge-triggered input pin 11 of device U5B, a non-retriggerable monostable multivibrator circuit, drives the inputs of devices U7A-U7F, an inverting CMOS to TTL driver device, thereby supplying a signal to the gate of device Q4, and activating device Q4 to initiate current flow through the primary of transformer T2 in FIG. 12. An ECU would take the place of devices U6A, U5B, and U7A-U7F of FIG. 12 to supply a continuously variable delay signal and vary the pre-plasma delay duration in response to sensed or monitored engine operating conditions. A high voltage buildup then occurs in the secondary of transformer T2. Once the output voltage or secondary of transformer T2 exceeds the sustaining voltage present across the ignitor gap 126 of FIG. 13, current is provided through connection TP-1, a high voltage connection wired directly to the pre-plasma circuit 120 to the ignitor gap 126. Again, as in the earlier embodiment shown in FIG. 2, the signal provided by transformer T2 of FIG. 12 acts to stabilize the plasma sustaining voltage for creating a highly conductive ionized channel across the ignitor gap 126 of FIG. 13.

Once stabilization of the sustaining voltage occurs, and the sustaining voltage drops below 600 volts, the output from the main-plasma circuit at connection J1-11 of FIGS. 7 and 13 begins to supply a current flow as diode 124 of FIG. 13 is now forward biased. A rapid drop in voltage occurs at the output of the main-plasma circuit 110 of FIG. 13 and the dv/dt rate of voltage change, when sufficiently high, triggers the input of device U5A of FIG. 8 thereby inhibiting the DC/DC converter circuit of FIGS. 6, 7, and 8. Energy storing capacitor C11 and C13 of FIG. 7 is discharged through inductor L3 and diode 124 of FIG. 13 into the ignitor gap 126. Inductor L3 of FIG. 7 provides a pulse shaping function in order to create a sinusoidal current pulse which is supplied to the ignitor gap 126 of FIG. 13.

Referring now to FIG. 13, a schematic illustration of the interconnections between the pre-plasma circuit 120 of FIGS. 9–12 and the main-plasma circuit 110 of FIGS. 6–8 is shown. Both the pre-plasma circuit 120 and the main-plasma circuit 110 share a common DC power supply signal supplied to input connections J1-5 and J1-6 of circuits 120 and 110. A trigger signal for initiating plasma ignition is provided to input J1-1 of pre-plasma circuit 120. The primary of a high voltage transformer T5 is connected to connections J1-11 and J1-9 of the pre-plasma circuit 120. The output or secondary of high voltage transformer T5 is connected to a high voltage summing diode 123 and to signal ground at connections J1-7 of circuits 110 and 120. The pre-plasma output signal supplied to connection TP-1 of circuit 120 is supplied through summing diode 122 to the ignitor gap 126. The main-plasma circuit output signal found at connection J1-11 is supplied through summing diode 124 to ignitor gap 126.

Those skilled in the art will recognize that the separate DC-DC converters employed in FIGS. 6–12 can be combined into a single high voltage supply. Those skilled in the art will also recognize that other methods of coupling the main plasma 112 and the pre-plasma 110 of FIG. 13 to the ignitor 126 are readily apparent, such as a tapped diode or suitable spark gaps. Additionally, a conventional flyback high voltage ignition circuit as found in most automotive engine ignition systems can substitute for the capacitive discharge high voltage circuits shown in FIGS. 2, 2A and 6–12 used to produce a high voltage spark across the ignitor gap of the embodiment shown.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for creating a highly conductive ionized channel for the flow of plasma current between two electrodes thereby inducing combustion of an air-fuel mixture in an engine, the method comprising the steps of:

(a) supplying a high voltage signal to a first electrode to induce breakdown to a second electrode;

(b) providing a predetermined time delay;

(c) supplying a short duration high voltage-high current pre-plasma signal to said first electrode to expand said conductive ionized channel and lower the resistance of said channel; and (d) supplying a low-voltage, high current main plasma signal to said first electrode to induce a main plasma flow between said electrodes.

2. The method of claim 1 wherein said predetermined time delay is varied in accordance with variations in a sensed engine operating condition.

3. The method of claim 2 wherein said sensed engine operating condition is RPM of said engine.

4. The method of claim 2 wherein said sensed engine operating condition is engine vacuum.

5. The method of claim 2 wherein said sensed engine operating condition is temperature of said engine.

6. The method of claim 2 wherein said sensed engine operating condition is the load upon said engine.

7. A plasma flow ignition apparatus comprising:

an ignitor device having a first and a second electrode;

first circuit means connected to said ignitor device for supplying a high voltage signal to said first electrode and inducing a high voltage spark across said electrodes;

second circuit means connected to said ignitor device for supplying a pre-plasma current pulse output signal to said first electrode and for providing a plasma flow sustaining voltage to said electrodes;

timing control means connected to said first and said second circuit means for enabling the pre-plasma current pulse output signal a predetermined time delay after the occurrence of said high voltage spark across said electrodes; and power supply means for supplying power to said first circuit means and said second circuit means.

8. The plasma flow ignition apparatus of claim 7 wherein said timing control means is an engine control unit including means for sensing engine speed and varying said predetermined time delay in relation to sensed engine speed.

9. The plasma flow ignition apparatus of claim 7 wherein said timing control means is an engine control unit including means for sensing engine load conditions and varying said predetermined amount of time delay in relation to sensed engine load.

10. The plasma flow ignition apparatus of claim 7 wherein said timing control means is an engine control unit including means for sensing ambient conditions and varying said predetermined time delay in relation to sensed ambient conditions.

11. The plasma flow ignition apparatus of claim 7 wherein said first circuit means includes a high voltage transformer having a primary winding and a secondary winding, said primary winding connected to said power supply means at a first lead and electrical switching means connected between a second lead of said primary winding and a signal ground potential, said secondary winding leads of said high voltage transformer coupled to said first electrode and ground respectively.

12. The plasma flow ignition apparatus of claim 11 wherein said second circuit means includes a transformer having a primary and a secondary winding, said primary winding of said transformer connected to said power supply means at a first lead and to a ground switching means at a second lead, said secondary winding of said transformer coupled with said first electrode and said signal ground.

13. The plasma flow ignition apparatus of claim 12 wherein said power supply means is a DC-DC converter.

14. A plasma flow ignition device comprising:

an ignitor gap device including a first and a second electrode;

first circuit means connected to said first electrode for supplying a high voltage signal to said first electrode and inducing a high voltage spark from said first to said second electrodes;

second circuit means connected to said first electrode for supplying a pre-plasma current pulse signal to said first electrode after said spark has formed across said ignitor gap device electrodes;

third circuit means connected to said first electrode for supplying current to said first electrode to cause main plasma flow between said electrodes after said second circuit means has supplied said current pulse signal to said first electrode;

timing means connected to said first circuit means and connected to said second circuit means for controlling the timing of said pre-plasma current pulse supplied to said first electrode relative to the timing of said high voltage signal, said timing varied according to engine operating conditions; and power supply means connected to said first, second and third circuit means for supplying power to said first, second and third circuit means.

15. The plasma flow ignition apparatus of claim 14 wherein said first circuit means includes a high voltage transformer having a primary winding and a secondary winding, said primary winding connected to said power supply means at a first lead and electrical switching means connected between a second lead of said primary winding and a ground signal, said secondary winding leads of said high voltage transformer coupled with said first electrode and ground.

16. The plasma flow ignition apparatus of claim 14 wherein said second circuit means includes a transformer having a primary and a secondary winding, said primary winding of said transformer connected to said high voltage power supply means at a first lead and to a switching means at a second lead, said secondary winding of said transformer coupled with said first electrode and signal ground, and said switching means also connected to said signal ground.

17. The plasma flow ignition apparatus of claim 14 wherein said power supply means includes a DC-DC converter for converting a low voltage DC power input signal to a high voltage power input signal.

18. The plasma flow ignition apparatus of claim 17 including charge storing means connected in parallel with the output of said DC-DC converter means, and inhibiting circuit means for inhibiting the output of said DC-DC converter when said pre-plasma and main plasma current signals are supplied to said first electrode.

19. The plasma flow ignition apparatus of claim 14 including rectifier means interposed between the outputs of said first, second, and third circuit means and said first electrode.

20. The plasma flow ignition apparatus of claim 19 wherein said rectifier means are high voltage diodes.

21. The plasma flow ignition apparatus of claim 14 including auxiliary gap means interposed between the output of said first circuit means and said first electrode.

22. The plasma flow ignition apparatus of claim 14 wherein said timing means is an engine control unit including means for sensing engine speed and varying said timing of said pre-plasma current pulse in relation to sensed engine speed.

23. The plasma flow ignition apparatus of claim 14 wherein said timing means is an engine control unit including means for sensing engine load conditions and varying said timing of said pre-plasma current pulse in relation to sensed engine load.

24. The plasma flow ignition apparatus of claim 14 wherein said timing means is an engine control unit including means for sensing ambient conditions and varying said timing of said pre-plasma current pulse in relation to sensed ambient conditions.

* * * * *

UNITED STATES PATENT AND TRADEMARK OFFICE

CERTIFICATE OF CORRECTION

PATENT NO. : 4,996,967

DATED : March 5, 1991

INVENTOR(S) : Mark A. Rosswurm, et al.

It is certified that error appears in the above-identified patent and that said Letters Patent is hereby corrected as shown below:

In column 3, line 47, between the words "process" and "SCR1" insert the word --switch--.

Signed and Sealed this

Twenty-third Day of June, 1992

*Attest:*

DOUGLAS B. COMER

*Attesting Officer*

*Acting Commissioner of Patents and Trademarks*